US005138926A

United States Patent [19]

Stier et al.

[11] Patent Number: 5,138,926

[45] Date of Patent: Aug. 18, 1992

[54] LEVEL CONTROL SYSTEM FOR AUTOMATIC ACCOMPANIMENT PLAYBACK

[75] Inventors: Glenn Stier, Vernon Hills; Thomas E. Hill, Prospect Heights; B. Loch Miwa, Crestwood; Alberto Kniepkamp, Hawthorn Woods, all of Ill.

[73] Assignee: Roland Corporation, Osaka, Japan

[21] Appl. No.: 583,837

[22] Filed: Sep. 17, 1990

[51] Int. Cl.[5] ..... G10H 1/057

[52] U.S. Cl. ..... 84/615; 84/634; 84/666

[58] Field of Search ..... 84/633, 658, 665, 634, 84/741, 666, 615

[56] References Cited

U.S. PATENT DOCUMENTS

| | | | |
|---|---|---|---|
| 4,433,601 | 2/1984 | Hall et al. | 84/713 |
| 4,674,384 | 6/1987 | Sakurai | 84/626 |
| 4,723,467 | 2/1988 | Kato | 84/DIG. 12 |
| 4,875,400 | 10/1989 | Okuda et al. | 84/626 |
| 4,930,390 | 6/1990 | Kellogg et al. | 84/611 |
| 4,962,688 | 10/1990 | Suzuki et al. | 84/600 |
| 4,972,753 | 11/1990 | Adachi et al. | 84/626 |
| 5,010,799 | 4/1991 | Tanaka et al. | 84/627 |
| 5,029,508 | 7/1991 | Suzuki et al. | 84/616 |

*Primary Examiner*—William M. Shoop, Jr.
*Assistant Examiner*—Brian Sircus

[57] ABSTRACT

An electronic musical instrument includes an emphasis circuit for independently modifying the level of each musically encoded data channel of a selected automatic accompaniment pattern in response to a parameter characterizing key operation, such as key velocity or key aftertouch force. Channel level modification is effected by modifying the MIDI velocity data byte of each channel in accordance with a value selected from a respective emphasis table in response to the current value of the key operating parameter.

27 Claims, 2 Drawing Sheets

LEVEL CONTROL SYSTEM FOR AUTOMATIC ACCOMPANIMENT PLAYBACK

BACKGROUND OF THE INVENTION

The present invention relates generally to electronic musical instruments and particularly concerns improved automatic accompaniment systems for electronic musical instruments.

Electronic musical instruments, most notably of the keyboard variety, which are capable of automatically playing a musical pattern or rhythm to accompany a melody played by a performer are well known in the art. The automatic accompaniment can be created in a variety of different styles and the instrumentation, rhythm and chord patterns can be changed by the performer to add variety to the accompaniment. U.S. Pat. No. 4,433,601 to Hall et al. is exemplary of an electronic keyboard musical instrument having such an automatic accompaniment capability.

The automatic accompaniment generated by prior art instruments is often multitimbral and may include for instance, a drum section, a bass line and a string section. During the performance of the musical piece, a preset balance is typically maintained between the various sections and can only be changed by altering the level setting established for the different sections by the use of sliders or other similar controllers. Manipulation of these controllers by the performer is cumbersome and detracts from the performance of the musical piece. In addition, subtle real time nuances in the orchestral balance are extremely difficult if not impossible to achieve.

Prior art automatic accompaniment generators also do not allow for real time variation of the relative balance between plural instruments contained in the same single section of the accompaniment. For example, it may be desirable to accent the sustained string sounds with occasional trumpet "stabs", or a countermelody played on a trombone, scored in the same accompaniment section and recalled at the discretion of the performer.

It is known in the art to effect level control in a keyboard electronic musical instrument in response to key velocity or key aftertouch force. However, the entire performance is equally effected by the level change introduced by this approach thereby leaving the original balance between the different instrument sections, or the relative balance between the instruments of a given single section, unaltered.

The foregoing limitations of prior art automatic accompaniment generators, and particularly performance level controllers used in association therewith, do not allow for a true representation of the playing of a real live orchestra, where the balance constantly changes, and the instrumental sections are faded in and out, following the demands of the musical score.

It is therefore a basic object of the present invention to provide an improved automatic accompaniment system for an electronic musical instrument.

It is a further object of the invention to provide an improved system for controlling the level balance during the playback of an automatic accompaniment in an electronic musical instrument.

It is yet another object of the invention to provide a system which affords real time control by the performer of the level balance between the different instrumental sections, or the relative balance between the instruments of a given single section, of an automatic accompaniment.

It is still a further object of the invention to provide a level balance control system for an electronic musical instrument which may be conveniently operated by the performer with a minimum of effort and whose operation results in a more natural and less mechanical performance of automatic accompaniment patterns.

BRIEF DESCRIPTION OF THE DRAWINGS

These and other objects and advantages of the invention will be apparent on reading the following description in conjunction with the drawings, in which.

DESCRIPTION OF THE PREFERRED EMBODIMENT

Figure 1:
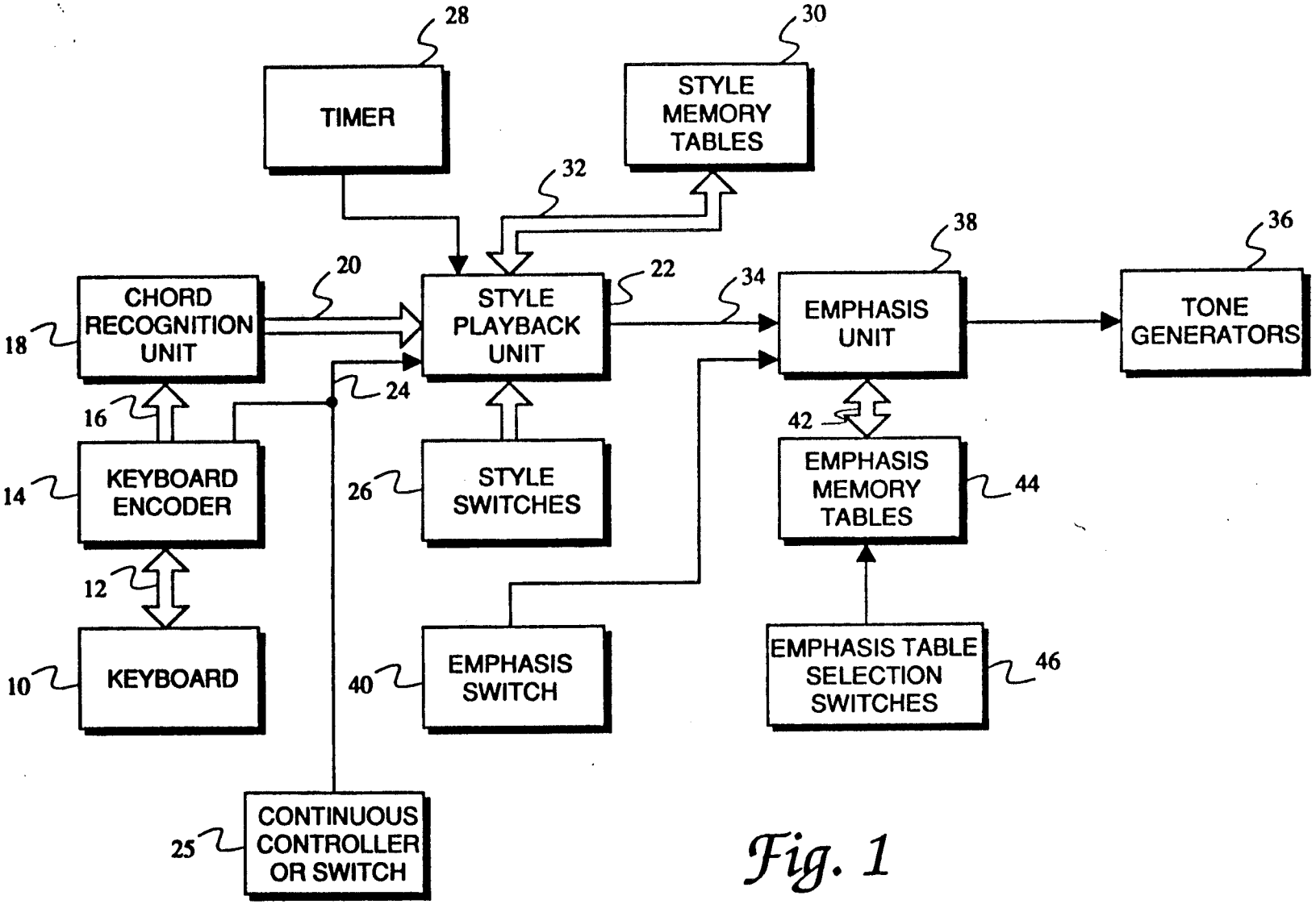
FIG. 1 is a block diagram illustrating an electronic keyboard musical instrument embodying the present invention.

Referring to the drawings, FIG. 1 is a block diagram illustrating an electronic keyboard musical instrument incorporating a preferred embodiment of the present invention. As will be described in more detail below, level balance control between the different sections of an automatic accompaniment pattern, or the relative balance between the individual instruments of a given single section, is achieved in the illustrated instrument by selectively modifying MIDI (Musical Instrument Digital Interface) velocity bytes in response to a parameter characteristic of key operation, such as key velocity or key aftertouch force.

Referring more specifically to FIG. 1, an electronic musical instrument comprises a keyboard 10 which includes a plurality of keys, at least some of which may be operated by a performer for selecting an accompaniment chord for playing. Keyboard 10 is coupled by a bi-directional bus 12 to a keyboard encoder 14 which includes an output bus 16 for supplying key codes identifying the operated keys on keyboard 10 to a chord recognition unit 18. Chord recognition unit 18 is responsive to the key codes supplied on bus 16 for identifying the accompaniment chord played by the performer on keyboard 10 and for providing a corresponding chord information signal on an output bus 20. The chord information signal supplied by chord recognition unit 18 may identify the chord root (e.g. C chord, etc.) and the chord type (e.g. minor or major chord). The chord information signal is supplied by bus 20 to a style playback unit 22, whose operation will be described in more detail hereinafter. Keyboard encoder 14 includes a second output 24 which is coupled to a further input of style playback unit 22. Output 24 comprises an input velocity signal which reflects a selected parameter characteristic of the manner in which the keys on keyboard 10 are played. This parameter is preferably either key velocity or key aftertouch force, whereby the input velocity signal reflects either the velocity with which the keys are played or the aftertouch force applied to the played keys. Alternatively, the input velocity signal can be multiplexed with the key codes on bus 16 and supplied to style playback unit 22 through the chord recognition unit 18. The input velocity signal may also be provided to style playback unit 22 by means of other input devices, such as a continuous controller, for example, a pitch wheel, or a switch as shown at 25.

Style playback unit 22 additionally receives inputs from a plurality of performer operable style switches 26, from a timer 28 and from a plurality of style tables stored in a memory 30. Each of the style tables of memory 30, which are individually selectable in response to the operation of style switches 26, stores data defining the style of a particular automatic accompaniment playback pattern in the form of a plurality (preferably sixteen) of MIDI channels. As is well known by those skilled in the art, each MIDI channel is normally addressed for reproducing the sound of a selected instrument and comprises a variety of mode and voice messages. These musically encoded messages define the characteristics of the sound to be reproduced, such as its pitch, level, timber and duration characteristics. The level of each note of a respective channel, i.e. the volume at which the note will be reproduced, is defined by a MIDI velocity byte, which may have values between 0–127. A velocity byte having a value of 0 is equivalent to muting the channel whereas a velocity byte having a value of 127 provides maximum volume.

In accordance with the present invention, the style tables of memory 30 also store an emphasis table number byte for each encoded MIDI channel. As will be explained in further detail hereinafter, the encoded emphasis table number byte, together with the input velocity value provided on line 24, provide a powerful yet convenient capability for effecting level balance control between the different sections of an automatic accompaniment pattern, or the relative balance between the individual instruments of any single musical section.

Returning to FIG. 1, the MIDI data (including the emphasis table number bytes) from the selected style table of memory 30 is supplied to style playback unit 22 over a bidirectional bus 32. Style playback unit 22 appropriately transposes or modifies the MIDI data supplied on bus 32 in accordance with the chord information signal supplied on bus 20. The resulting signal, which is entirely conventional, except for the encoded emphasis table number byte in each MIDI channel, is multiplexed with the input velocity signal from line 24 and supplied on an output line 34. The MIDI data on output 34 is normally coupled directly to a tone generator unit 36 for reproducing the automatic accompaniment pattern defined thereby. However, in accordance with the present invention, an emphasis unit 38 is interposed between output 34 of style playback unit 22 and tone generator unit 36. Emphasis unit 38, whose operation may be enabled or disabled by the performer through an emphasis switch 40, is coupled by a bi-directional bus 42 to a memory 44 storing a plurality of emphasis tables. Memory 44 may comprise a suitably programmed ROM, a memory cartridge or disc or any other preprogrammed or user programmable memory device. Also, a plurality of switches 46 may be provided to allow the performer to assign different emphasis tables to different MIDI channels.

Figure 2:
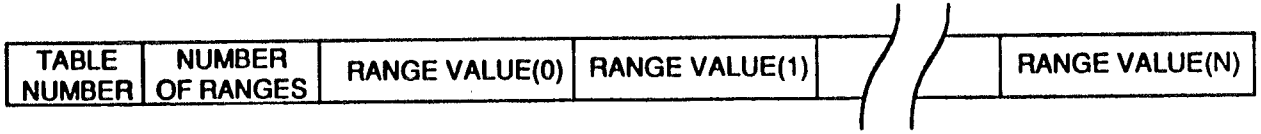
FIG. 2 is a chart illustrating the format of an emphasis table stored in memory 44 of FIG. 1.

The format of each emphasis table stored in memory 44 is illustrated in FIG. 2. As shown in this Figure, each table comprises a table number, a byte defining the number of range values stored in the table and a plurality of range values. While any number of range values between 1 and 128 may be stored in a given table, it has been found that ten values is a sufficient number to achieve the objectives of the invention. Each stored range value is typically assigned a level between 0 and 100%, although levels exceeding 100% may also be used as explained hereinafter.

The function of emphasis unit 38 is essentially that of modifying the velocity bytes of a given MIDI channel as a function of the range values stored in a corresponding emphasis table of memory 44 and the input velocity signal supplied on line 24. The velocity bytes of each MIDI channel coupled to tone generator unit 36 may thereby be conveniently controlled by the performer in response to, for example, key playing velocity or key aftertouch force. As such, a convenient control is provided to the performer for selectively varying the level balance between the different sections of the automatic accompaniment pattern defined by the MIDI data, or the relative balance between the individual instruments in a single section.

Figure 3:
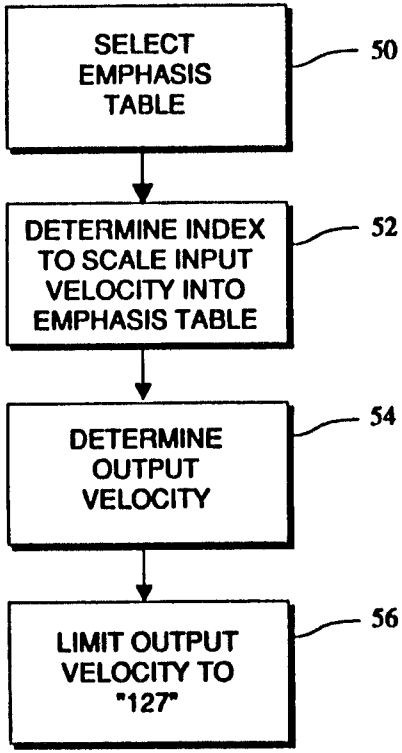
FIG. 3 is a simplified flow chart illustrating the operation of the balance level control system of the electronic musical instrument of FIG. 1.

The operation of emphasis unit 38 is more specifically illustrated in the flow chart of FIG. 3. Initially, in a step 50, emphasis unit 38 assigns each MIDI channel of the selected automatic accompaniment pattern to a particular emphasis table in memory 44. The emphasis table selection is made by matching the emphasis table number byte assigned to the channel by the selected style table (stored in memory 30) with the table numbers of the emphasis tables stored in memory 44. Next, the input velocity signal from line 24, representing, for example, key velocity or key aftertouch force, is scaled into the table of each respective channel by deriving an Index value therefore in a step 52. The Index values are derived according to the expression:

$$\text{Index} = (\text{Input Velocity}) / (128/\text{No. of Ranges}).$$

The derived Index value for each channel selects one of the range values stored in the respective emphasis table as a function of the level of the input velocity signal. Thus, range value (0) is selected for low level input velocity signals, range value (1) for somewhat higher level input velocity signals and so on, with range value (n) being selected for the highest level input velocity signals. The stored range value selected in accordance with the derived Index value for each channel is then used to modify the MIDI velocity byte of the corresponding channel in a step 54. This modification provides an output velocity byte according to the expression:

$$\text{Output Velocity} = (\text{MIDI velocity byte} * \text{Range Value}) / 100.$$

The output velocity byte is then limited to a value of 127, the maximum level of a MIDI velocity byte, in a step 56 and coupled to tone generator unit 36 for reproducing the channel in accordance with the modified velocity byte.

Figure 4:
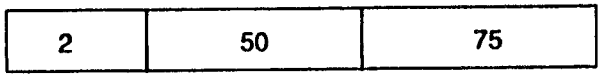
FIG. 4 is a chart illustrating an exemplary emphasis table of the shown generally in FIG. 2.

A simplified example of the foregoing operation is illustrated in FIG. 4 which represents an emphasis table for a particular MIDI channel comprising two (2) range values, the first range value having a level of 50 and the second range value having a level of 75. Assume first that the performer plays a key on keyboard 10 resulting in an input velocity signal on line 24 having, for example, a level of 32 corresponding to either depressing the key with moderately low velocity or moderately low aftertouch force. The Index value is derived according to step 52 of FIG. 3 as 32/64, representing an Index value of "0" and selection of the first range value whose level is 50. If the nominal MIDI velocity byte provided by the style table represented the mid-range level of 64, this level would accordingly be modified in step 54 to provide an output velocity byte having a level of 32, i.e. (64 * 50) / 100. Thus, by playing the keyboard relatively lightly, the performer has automatically reduced the nominal level of the MIDI channel corresponding to the emphasis table of FIG. 4 by a factor of one-half.

The nominal level (i.e. 64) of the MIDI channel can likewise be reduced by a factor of ¾ by either playing the key with more velocity or more aftertouch force. That is, if the keyboard is played such that an input velocity signal having, for example, a level of 96 is provided on line 24, the Index derived in step 52 (Index=96/64=1.5) would select the second range value whose level is 75. The output velocity would thereby be 64 * (75/100)=48, representing a reduction of ¾ in the nominal MIDI velocity byte.

It will be appreciated that the MIDI velocity byte stored in a particular style table could likewise be modified to provide an increased output velocity byte rather than a reduced output velocity byte as described above. In particular, if the level of a given range value is greater than 100, the MIDI velocity byte will be modified by a corresponding increase in value whenever that range value is selected through operation of the keyboard. Many other effects are also possible. For example, the output velocity can be made to track the MIDI velocity byte by setting one or more range values equal to 100. Also, the modification can be selected to effectively mute a channel by setting one or more range values equal to zero.

Figure 5:
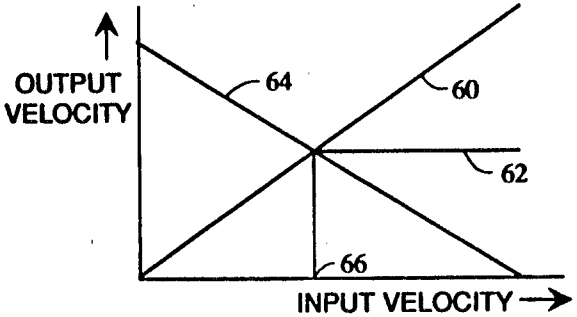
FIGS. 5 and 6 illustrate in chart form exemplary musical affects provided by the level control system of the invention.

In accordance with the foregoing, it will be appreciated that numerous musical effects can be conveniently achieved by the performer simply by playing the keys of keyboard 10 and suitably programming the emphasis tables stored in memory 44 corresponding to the various MIDI channels provided by the style tables of memory 30. The level balance between various channels can be controlled in response to keyboard playing by emphasizing one or more channels while de-emphasizing other channels. Also, selected channels can be muted or can be made to track the corresponding MIDI velocity bytes. FIG. 5 illustrates an exemplary effect which can be achieved according to the invention. As shown, an accompaniment pattern includes a piano pattern 60, a trumpet pattern 62 and a saxophone pattern 64, each comprising a respective MIDI channel. The output velocity or level of the piano pattern 60 tracks the MIDI velocity and can be effected by assigning an emphasis table having a single range value of 100 to the corresponding MIDI channel. The output velocity of the saxophone channel is inversely related to its input velocity and can be effected by assigning an emphasis table to the channel having a series of range values which gradually decrease from a value greater than 100 for minimum input velocities to a relatively small value for maximum input velocities. The trumpet channel 62 can be effected by an emphasis table having a zero level range value for smaller input velocities and subsequent range value levels selected for providing a relatively constant output velocity with increasing input velocity levels. The overall affect is that at relatively low input velocities, only the piano and saxophone patterns are sounded, with the piano pattern 60 tracking input velocity and the saxophone pattern 64 decreasing in level with increasing input velocity. The trumpet pattern 62 will be introduced into the accompaniment pattern at an input velocity corresponding to point 66 and continue at a relatively constant level for higher input velocities.

Figure 6:
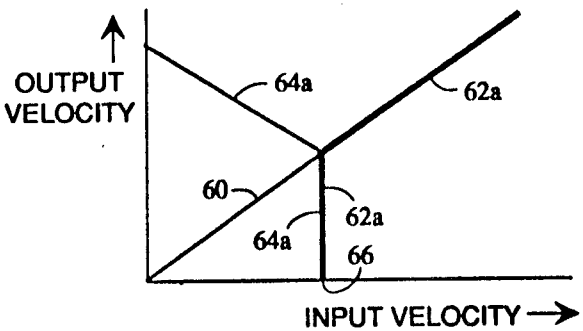

It will be appreciated that numerous other patterns may be achieved by simply changing the emphasis tables assigned to the respective MIDI channels. For example, the trumpet and saxophone channels of FIG. 5 can be altered as shown in FIG. 6 by appropriately changing the emphasis tables assigned to these channels. In FIG. 6, the trumpet channel **62*a* has been modified so that it is again muted for input velocities below point 66, but now tracks input velocities greater than point 66. The saxophone pattern 64*a* is similar to pattern 64 in FIG. 5 for input velocities less than point 66, but is muted for input velocities having a level greater than point 66**.

With the invention, a method of conveniently controlling the relative balance between the individual MIDI channels of an automatic accompaniment pattern is thus made available. It is recognized that numerous changes and modifications in the described embodiment of the invention may be made without departing from its true spirit and scope. Thus, for example, while the input velocity signal is preferably derived as a function of keyboard playing characteristics, such as key velocity or key aftertouch force, a separate variable controller can be used for this purpose. The invention is therefore to be limited only as defined in the claims appended hereto.

What is claimed is:

1. An electronic musical instrument comprising:

means for supplying a selected automatic accompaniment pattern comprising a plurality of channels of preprogrammed musically encoded data, each channel including a data signal representing the level at which the respective channel is to be reproduced;

means operable by a performer during playback of said automatic accompaniment pattern for providing an input control signal; and means for independently modifying the data signal of each of said channels according to a modification value selected from a respective stored function in response to said input control signal.

2. The electronic musical instrument of claim 1 wherein said control means comprises a keyboard including a plurality of keys, said means for modifying being responsive to a parameter reflecting the operation of at least some of said keys for modifying the data signal of each of said channels according to said respective stored functions.

3. The electronic musical instrument of claim 2 wherein said modifying means is responsive to the velocity at which said keys are operated for modifying the data signal of each of said channels according to said respective stored functions.

4. The electronic musical instrument of claim 2 wherein said modifying means is responsive to the aftertouch force with which said keys are operated for modifying the data signal of each of said channels according to said respective stored functions.

5. The electronic musical instrument of claim 1 wherein said control means comprises a manually operable continuous controller, said means for modifying being responsive to said continuous controller for modifying the data signal of each of said channels according to said respective stored functions.

6. The electronic musical instrument of claim 1 wherein said control means comprises a manually operable switch means, said means for modifying being responsive to said switch means for modifying the data signal of each of said channels according to said respective stored functions.

7. The electronic musical instrument of claim 1 wherein the stored function corresponding to at least one of said channels comprises a plurality of discrete range values and wherein said modifying means is responsive to said input control signal for selecting one of said plurality of range values for modifying the data signal of the respective channel.

8. The electronic musical instrument of claim 1 including memory means for storing each of said stored functions in the form of a memory table having one or more values, said modifying means being operable for modifying the data signal of each of said channels in accordance with a value selected from the corresponding table in response to said input control signal.

9. The electronic musical instrument of claim 8 wherein each of said channels includes a table number data signal identifying one of said stored memory tables, said modifying means using the so identified memory table for modifying the data signal of the corresponding channel.

10. The electronic musical instrument of claim 9 wherein each of said channels comprises a MIDI channel and wherein each of said data signals comprises a MIDI velocity data byte defining the level of each note of a respective channel.

11. The electronic musical instrument of claim 10 including means for limiting each modified MIDI velocity data byte to a predetermined maximum value.

12. An electronic musical instrument comprising:

memory means for storing a plurality of memory tables each comprising one or more discrete level modification values;

means for supplying a selected automatic accompaniment pattern comprising a plurality of channels of preprogrammed musically encoded data, each of said channels being characterized by a first data signal representing the level at which the respective channel is to be reproduced and including a second data signal identifying one of said stored memory tables;

control means operably by a performer during playback of said automatic accompaniment pattern for providing an input control signal; and means for modifying the first data signal of each of said channels in accordance with one of said level modification values stored in the memory table identified by the respective second data signal and selected in response to said input control signal.

13. The electronic musical instrument of claim 12 wherein said control means comprises a keyboard including a plurality of keys, said means for modifying being responsive to a parameter reflecting the operation of at least some of said keys for modifying the first data signal of each of said channels.

14. The electronic musical instrument of claim 13 wherein said modifying means is responsive to the velocity at which said keys are operated for modifying the first data signal of each of said channels.

15. The electronic musical instrument of claim 13 wherein said modifying means is responsive to the aftertouch force with which said keys are operated for modifying the first data signal of each of said channels.

16. The electronic musical instrument of claim 12 wherein said control means comprises a manually operably continuous controller, said means for modifying being responsive to said continuous controller for modifying the first data signal of each of said channels.

17. The electronic musical instrument of claim 12 wherein said control means comprises a manually operable switch means, said means for modifying being responsive to said switch means for modifying the first data signal of each of said channels.

18. An electronic musical instrument comprising:

a keyboard having a plurality of keys;

memory means for storing a plurality of memory tables each comprising one or more discrete level modification values;

means for supplying a selected automatic accompaniment pattern comprising a plurality of channels of preprogrammed musically encoded data, each of said channels being characterized by a first data signal representing the level at which the respective channel is to be reproduced and including a second data signal identifying one of said stored memory tables;

means responsive to the operation of at least some of said keys during playback of said automatic accompaniment pattern for generating an input control signal reflecting the value of a selected parameter associated with the operation of said keys; and means for modifying the first data signal of each of said channels in accordance with one of said level modification values stored in the memory table identified by the respective second data signal and selected in response to said input control signal.

19. The electronic musical instrument of claim 18 wherein said selected parameter comprises key velocity.

20. The electronic musical instrument of claim 18 wherein said selected parameter comprises key aftertouch force.

21. The electronic musical instrument of claim 18 including means for limiting each modified first data signal to a predetermined maximum value.

22. An electronic musical instrument comprising:

memory means for storing a plurality of memory tables each comprising one or more discrete musical parameter modification values;

means for supplying a selected automatic accompaniment pattern comprising a plurality of channels of preprogrammed musically encoded data, each of said channels being characterized by a first data signal representing a selected musical parameter and including a second data signal identifying one of said stored memory tables;

control means operably by a performer during playback of said automatic accompaniment pattern for providing an input control signal; and means for modifying the first data signal of each of said channels in accordance with one of said musical parameter modification values stored in the memory table identified by the respective second data signal and selected in response to said input control signal.

23. The electronic musical instrument of claim 22 wherein said control means comprises a keyboard including a plurality of keys, said means for modifying being responsive to a parameter reflecting the operation of at least some of said keys for modifying the first data signal of each of said channels.

24. The electronic musical instrument of claim 23 wherein said modifying means is responsive to the velocity at which said keys are operated for modifying the first data signal of each of said channels.

25. The electronic musical instrument of claim 23 wherein said modifying means is responsive to the aftertouch force with which said keys are operated for modifying the first data signal of each of said channels.

26. The electronic musical instrument of claim 22 wherein said control means comprises a manually operable continuous controller, said means for modifying being responsive to said continuous controller for modifying the first data signal of each of said channels.

27. The electronic musical instrument of claim 22 wherein said control means comprises a manually operable switch means, said means for modifying being responsive to said switch means for modifying the first data signal of each of said channels.

* * * * *